US011408150B2

(12) United States Patent
Yamamoto et al.

(10) Patent No.: US 11,408,150 B2
(45) Date of Patent: Aug. 9, 2022

(54) CONTROL SYSTEM FOR WORK VEHICLE, METHOD, AND WORK VEHICLE

(71) Applicant: KOMATSU LTD., Tokyo (JP)

(72) Inventors: Shigeru Yamamoto, Tokyo (JP); Eiji Ishibashi, Tokyo (JP); Takahiro Shimojo, Tokyo (JP)

(73) Assignee: KOMATSU LTD., Tokyo (JP)

( * ) Notice: Subject to any disclaimer, the term of this patent is extended or adjusted under 35 U.S.C. 154(b) by 323 days.

(21) Appl. No.: 16/482,029

(22) PCT Filed: Apr. 10, 2018

(86) PCT No.: PCT/JP2018/015115
§ 371 (c)(1),
(2) Date: Jul. 30, 2019

(87) PCT Pub. No.: WO2018/198761
PCT Pub. Date: Nov. 1, 2018

(65) Prior Publication Data

US 2019/0390443 A1 Dec. 26, 2019

(30) Foreign Application Priority Data

Apr. 27, 2017 (JP) ..... JP2017-088190

(51) Int. Cl.
*E02F 3/84* (2006.01)
*E02F 9/26* (2006.01)
*E02F 3/76* (2006.01)

(52) U.S. Cl.
CPC ..... *E02F 9/262* (2013.01); *E02F 3/844* (2013.01); *E02F 9/264* (2013.01); *E02F 3/7609* (2013.01)

(58) Field of Classification Search
CPC ..... E02F 9/262; E02F 3/844; E02F 3/7618; E02F 3/847; E02F 9/265; E02F 9/264;
(Continued)

(56) References Cited

U.S. PATENT DOCUMENTS 3,563,016 A * 2/1971 Tolochko ..... A01D 46/28 56/331
5,375,663 A * 12/1994 Teach ..... E02F 3/847 701/50

(Continued)

FOREIGN PATENT DOCUMENTS

CN 103967060 A 8/2014
CN 105386482 A 3/2016

(Continued)

OTHER PUBLICATIONS

The International Search Report for the corresponding international application No. PCT/JP2018/015115, dated Jun. 5, 2018.

(Continued)

*Primary Examiner* — Edwin J Toledo-Duran
(74) *Attorney, Agent, or Firm* — Global IP Counselors, LLP

(57) ABSTRACT

A work vehicle includes a work implement. A control system for the work vehicle includes a controller. The controller obtains first topographical data indicative of a topography of a work target before filling work. The controller obtains blade tip position data indicative of a blade tip position of the work implement during the filling work. The controller obtains second topographical data indicative of a compacted topography after the filling work. The controller determines a compression rate of the work target from the first topographical data, the blade tip position data, and the second topographical data.

17 Claims, 10 Drawing Sheets

(58) Field of Classification Search
CPC . E02F 3/7609; E02F 9/261; E02F 3/42; E02F 3/43; E02F 3/84; E02F 3/85; E02F 9/20; E02F 9/21; E02F 9/22; G05D 1/0212; G05D 2201/0202; G05D 1/0094
See application file for complete search history.

(56) References Cited

U.S. PATENT DOCUMENTS 5,646,844 A * 7/1997 Gudat ..... G05D 1/0297 701/50
5,735,065 A * 4/1998 Yamagata ..... E02F 3/437 701/50
5,835,874 A * 11/1998 Hirata ..... E02F 3/435 60/426
5,901,793 A * 5/1999 Frisbee ..... E02F 3/844 172/816
5,951,613 A * 9/1999 Sahm ..... E02F 3/847 701/50
5,968,104 A * 10/1999 Egawa ..... E02F 9/2285 701/50
6,169,948 B1 * 1/2001 Fujishima ..... E02F 9/26 340/684
6,275,757 B1 * 8/2001 Watanabe ..... E02F 9/2296 37/234
9,834,905 B2 * 12/2017 Matsuyama ..... E02F 3/32
9,834,908 B2 * 12/2017 Iwasaki ..... E02F 9/265
10,275,843 B2 * 4/2019 Shike ..... G06Q 10/06313
10,584,463 B2 * 3/2020 Matsuyama ..... E02F 3/436
11,053,667 B2 * 7/2021 Harada ..... E02F 3/844
2009/0214300 A1 * 8/2009 Birgisson ..... E02D 1/02 700/275
2013/0081831 A1 4/2013 Hayashi
2013/0315699 A1 * 11/2013 Matsuyama ..... E02F 9/262 701/50
2014/0277957 A1 * 9/2014 Olar ..... E02F 5/32 701/50
2015/0308081 A1 * 10/2015 Takaura ..... E02F 3/437 701/50
2016/0076223 A1 * 3/2016 Wei ..... E02F 9/265 701/50
2016/0097184 A1 * 4/2016 Matsuyama ..... E02F 9/2029 701/50
2016/0321763 A1 * 11/2016 Shike ..... G06Q 50/08

FOREIGN PATENT DOCUMENTS

EP 2 758 605 B1 12/2016
JP 61-84758 U 6/1986
JP 63-210315 A 9/1988
JP 5247939 B1 7/2013

OTHER PUBLICATIONS

The Office Action for the corresponding Chinese application No. 201880007596.4, dated Oct. 10, 2020.

* cited by examiner

CONTROL SYSTEM FOR WORK VEHICLE, METHOD, AND WORK VEHICLE

CROSS-REFERENCE TO RELATED APPLICATIONS

This application is a U.S. National stage application of International Application No. PCT/JP2018/015115, filed on Apr. 10, 2018. This U.S. National stage application claims priority under 35 U.S.C. § 119(a) to Japanese Patent Application No. 2017-088190, filed in Japan on Apr. 27, 2017, the entire contents of which are hereby incorporated herein by reference.

BACKGROUND

Field of the Invention

The present invention relates to a control system for a work vehicle, a method, and a work vehicle.

Background Information

An automatic control for automatically adjusting the position of a work implement has been conventionally proposed for work vehicles such as bulldozers or graders and the like. For example, Japanese Patent Publication No. 5247939 discloses an excavation control and a leveling control.

Under the excavation control, the position of the blade is automatically adjusted so that the load applied to the blade coincides with a target load. Under the leveling control, the position of the blade is automatically adjusted so that the tip of the blade moves along a final design surface which represents a target finish shape of the excavation target.

SUMMARY

Work performed by a work vehicle includes filling work as well as excavating work. During filling work, the work vehicle removes soil from a cutting with the work implement. The work vehicle then piles up the removed soil with the work implement. The soil is compacted by the work vehicle or another rolling vehicle traveling over the piled up soil. By repeating the above work and stacking the soil in layers, for example, the depressed topography is filled in and a flat shape can be formed.

When performing filling work, it is important that the layers of soil are formed to the desired thickness to perform the work efficiently and with good finishing quality. However, even if the soil is piled up in layers of a predetermined thickness, the thicknesses of the layers of compacted soil may differ according to the nature of the soil. For example, soft, low-density soil will be greatly compressed when compacted. Therefore, in comparison to hard, high-density soil, the layers of the compacted soft, low-density soil will be thinner. As a result, it is not easy to form the layers of soil to the desired thickness.

An object of the present invention is to provide a control system for a work vehicle, a method, and a work vehicle that enable filling work to be performed efficiently and with a quality finish.

A control system according to a first aspect is a control system for a work vehicle having a work implement, the control system comprising a controller. The controller is programmed so as to execute the following processing. The controller obtains first topographical data. The first topographical data indicates a topography of a work target before filling work. The controller obtains blade tip position data. The blade tip position data indicates the blade tip position of the work implement during the filling work. The controller obtains second topographical data. The second topographical data indicates a compacted topography after the filling work. The controller determines a compression rate of the work target from the first topographical data, the blade tip position data, and the second topographical data.

A second aspect is a method executed by a controller for determining a compression rate of a work target to be subjected to filling work with a work implement of a work vehicle, the method comprising the following processing. A first process is to obtain first topographical data. The first topographical data indicates a topography of the work target before the filling work. A second process is to obtain blade tip position data. The blade tip position data indicates the blade tip position of the work implement during the filling work. A third process is to obtain second topographical data. The second topographical data indicates a compacted topography after the filling work. A fourth process is to determine a compression rate of the work target from the first topographical data, the blade tip position data, and the second topographical data.

A third aspect is a work vehicle, the work vehicle comprising a work implement and a controller. The controller controls the work implement. The controller is programmed so as to execute the following processing. The controller obtains first topographical data. The first topographical data indicates a topography of a work target before filling work. The controller obtains blade tip position data. The blade tip position data indicates the blade tip position of the work implement during the filling work. The controller obtains second topographical data. The second topographical data indicates a compacted topography after the filling work. The controller determines a compression rate of the work target from the first topographical data, the blade tip position data, and the second topographical data. The controller controls the work implement on the basis of the compression rate.

According to the present invention, the compression rate of a work target for filling work can be obtained. As a result, the quality of the finished work can be improved and work efficiency can be improved.

DETAILED DESCRIPTION OF EMBODIMENT(S)

Figure 1:
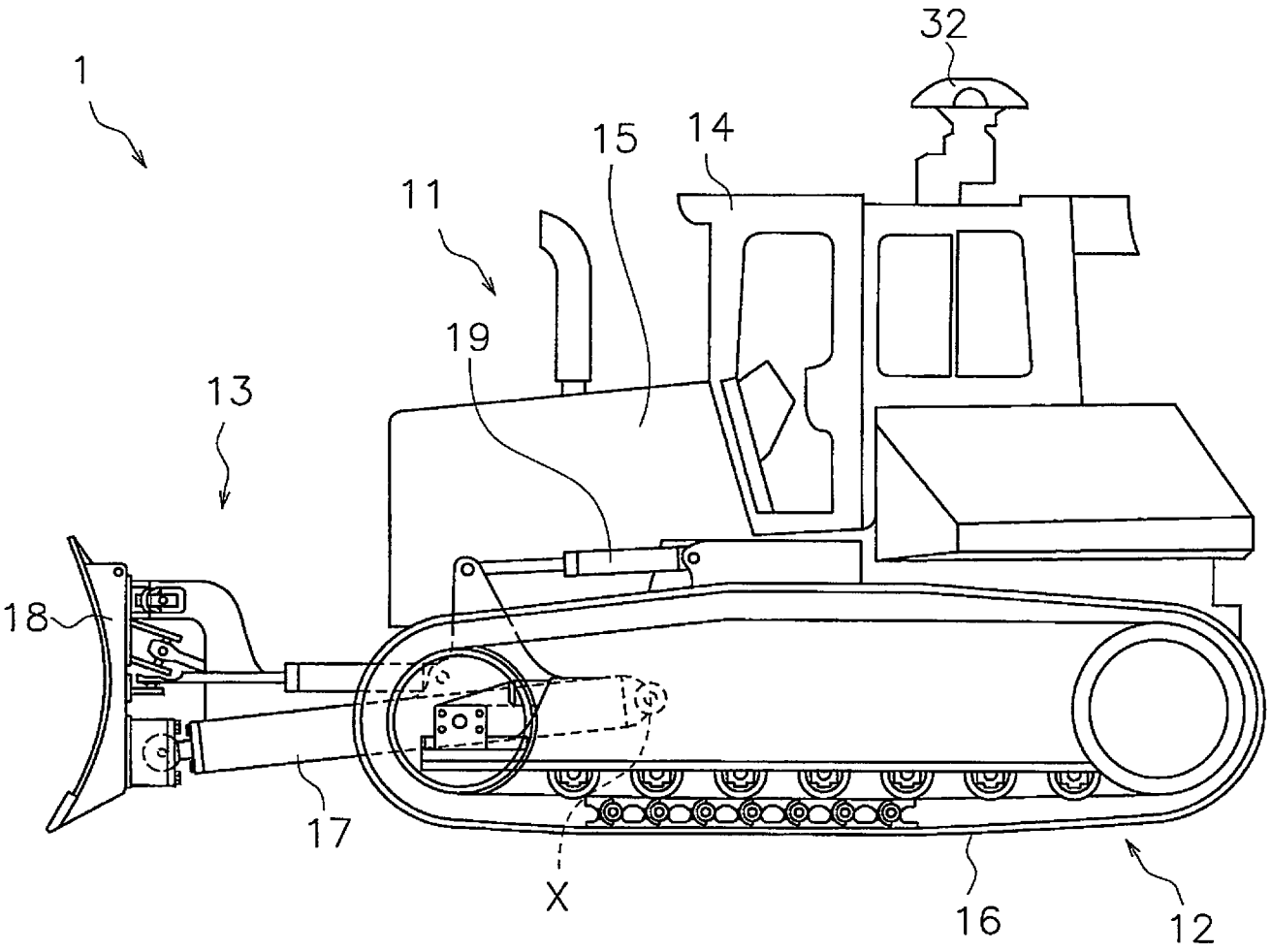
FIG. 1 is a side view of a work vehicle according to an embodiment.

A work vehicle according to an embodiment is discussed hereinbelow with reference to the drawings. FIG. 1 is a side view of a work vehicle 1 according to an embodiment. The work vehicle 1 according to the present embodiment is a bulldozer. The work vehicle 1 is provided with a vehicle body 11, a travel device 12, and a work implement 13.

The vehicle body 11 has an operating cabin 14 and an engine compartment 15. An operator's seat that is not illustrated is disposed inside the operating cabin 14. The engine compartment 15 is disposed in front of the operating cabin 14. The travel device 12 is attached to a bottom part of the vehicle body 11. The travel device 12 has a pair of left and right crawler belts 16. Only the crawler belt 16 on the left side is illustrated in FIG. 1. The work vehicle 1 travels due to the rotation of the crawler belts 16. The travel of the work vehicle 1 may be in the form of automated travel, semi-automated travel, or travel due to operations by an operator.

The work implement 13 is attached to the vehicle body 11. The work implement 13 has a lift frame 17, a blade 18, and a lift cylinder 19. The lift frame 17 is attached to the vehicle body 11 in a manner that allows movement up and down centered on an axis X that extends in the vehicle width direction. The lift frame 17 supports the blade 18.

The blade 18 is disposed in front of the vehicle body 11. The blade 18 moves up and down accompanying the up and down movements of the lift frame 17. The lift cylinder 19 is coupled to the vehicle body 11 and the lift frame 17. Due to the extension and contraction of the lift cylinder 19, the lift frame 17 rotates up and down centered on the axis X.

Figure 2:
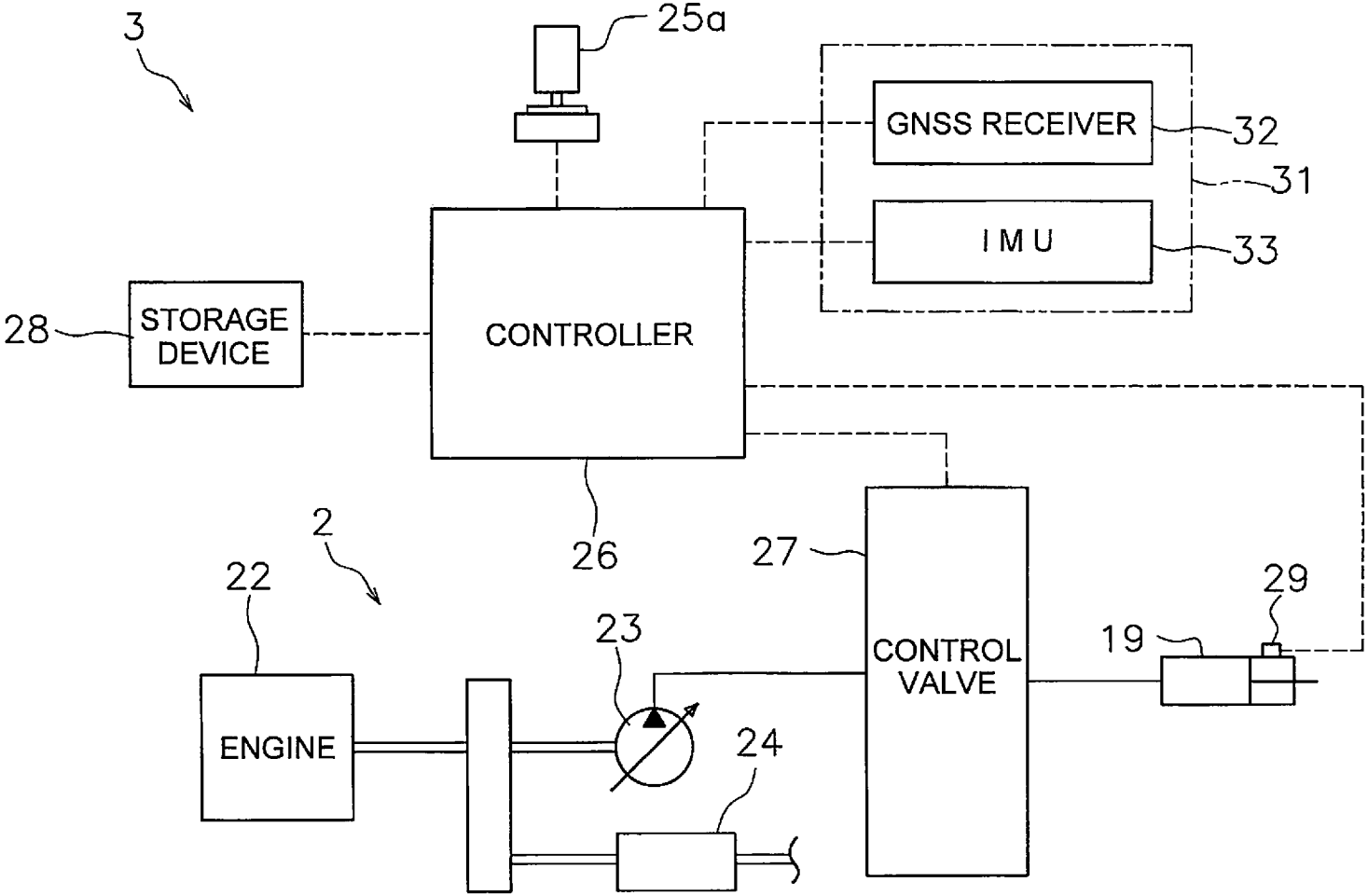
FIG. 2 is a block diagram illustrating a configuration of a drive system and a control system of the work vehicle.

FIG. 2 is a block diagram illustrating a configuration of a drive system 2 and a control system 3 of the work vehicle 1. As illustrated in FIG. 2, the drive system 2 is provided with an engine 22, a hydraulic pump 23, and a power transmission device 24.

The hydraulic pump 23 is driven by the engine 22 to discharge hydraulic fluid. The hydraulic fluid discharged from the hydraulic pump 23 is supplied to the lift cylinder 19. While only one hydraulic pump 23 is illustrated in FIG. 2, a plurality of hydraulic pumps may be provided.

The power transmission device 24 transmits driving power from the engine 22 to the travel device 12. The power transmission device 24 may be a hydrostatic transmission (HST), for example. Alternatively, the power transmission device 24, for example, may be a transmission having a torque converter or a plurality of speed change gears.

The control system 3 is provided with an operating device 25*a*, a controller 26, a control valve 27, and a storage device 28. The operating device 25*a* is a device for operating the work implement 13 and the travel device 12. The operating device 25*a* is disposed in the operating cabin 14. The operating device 25*a* accepts operations from an operator for driving the work implement 13 and the travel device 12, and outputs operation signals in accordance with the operations. The operating device 25*a* includes, for example, an operating lever, a pedal, and a switch and the like.

The operating device 25*a* for the travel device 12 is, for example, operably provided at a forward movement position, a reverse movement position, and a neutral position. An operation signal indicating the position of the operating device 25*a* is outputted to the controller 26. The controller 26 controls the travel device 12 or the power transmission device 24 so that the work vehicle 1 moves forward when the operating position of the operating device 25*a* is the forward movement position. The controller 26 controls the travel device 12 or the power transmission device 24 so that the work vehicle 1 moves in reverse when the operating position of the operating device 25*a* is the reverse movement position.

The controller 26 is programmed so as to control the work vehicle 1 on the basis of obtained data. The controller 26 includes, for example, a processing device (processor) such as a CPU. The controller 26 obtains operation signals from the operating device 25*a*. The controller 26 controls the control valve 27 on the basis of the operation signals.

The control valve 27 is a proportional control valve and is controlled by command signals from the controller 26. The control valve 27 is disposed between the hydraulic pump 23 and hydraulic actuators such as the lift cylinder 19. The control valve 27 controls the flow rate of the hydraulic fluid supplied from the hydraulic pump 23 to the lift cylinder 19.

The controller 26 generates a command signal to the control valve 27 so that the blade 18 moves in accordance with the abovementioned operations of the operating device 25*a*. As a result, the lift cylinder 19 is controlled in response to the operation amount of the operating device 25*a*. The control valve 27 may also be a pressure proportional control valve. Alternatively, the control valve 27 may be an electromagnetic proportional control valve.

Figure 3:
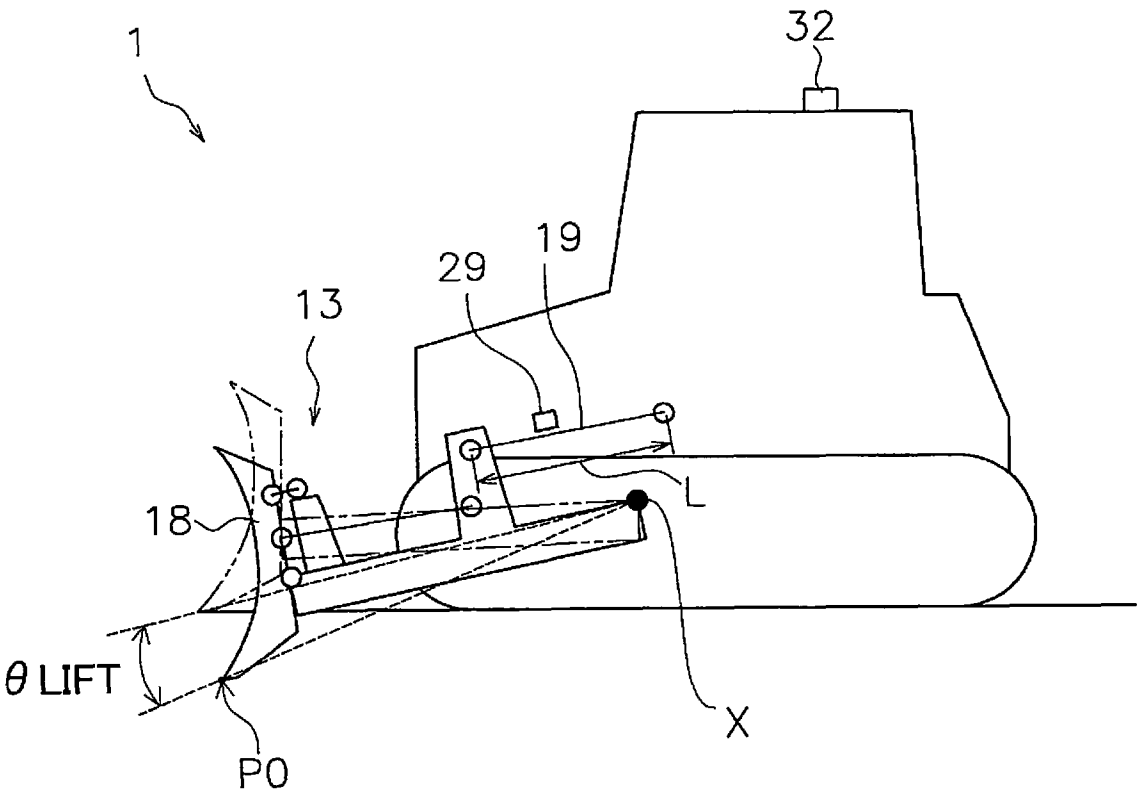
FIG. 3 is a schematic view of a configuration of the work vehicle.

The control system 3 is provided with a lift cylinder sensor 29. The lift cylinder sensor 29 detects the stroke length (referred to below as "lift cylinder length L") of the lift cylinder 19. As depicted in FIG. 3, the controller 26 calculates a lift angle θlift of the blade 18 on the basis of the lift cylinder length L. FIG. 3 is a schematic view of a configuration of the work vehicle 1.

The origin position of the work implement 13 is depicted as a chain double-dashed line in FIG. 3. The origin position of the work implement 13 is the position of the blade 18 while the tip of the blade 18 is in contact with the ground surface on a horizontal ground surface. The lift angle θlift is the angle from the origin position of the work implement 13.

As illustrated in FIG. 2, the control system 3 is provided with a position sensor 31. The position sensor 31 measures the position of the work vehicle 1. The position sensor 31 is provided with a global navigation satellite system (GNSS) receiver 32 and an IMU 33. The GNSS receiver 32 is a receiving apparatus for a global positioning system (GPS), for example. An antenna of the GNSS receiver 32 is disposed on the operating cabin 14. The GNSS receiver 32 receives a positioning signal from a satellite, calculates the position of the antenna from the positioning signal, and generates vehicle body position data. The controller 26 obtains the vehicle body position data from the GNSS receiver 32.

The IMU 33 is an inertial measurement unit. The IMU 33 obtains vehicle body inclination angle data. The vehicle body inclination angle data includes the angle (pitch angle) relative to horizontal in the vehicle front-back direction and the angle (roll angle) relative to horizontal in the vehicle lateral direction. The controller 26 obtains the vehicle body inclination angle data from the IMU 33.

The controller 26 computes a blade tip position P0 from the lift cylinder length L, the vehicle body position data, and the vehicle body inclination angle data. As illustrated in FIG. 3, the controller 26 calculates global coordinates of the GNSS receiver 32 on the basis of the vehicle body position data. The controller 26 calculates the lift angle θlift on the basis of the lift cylinder length L. The controller 26 calculates local coordinates of the blade tip position P0 with respect to the GNSS receiver 32 on the basis of the lift angle θlift and vehicle body dimension data.

The controller 26 calculates the traveling direction and the vehicle speed of the work vehicle 1 from the vehicle body position data. The vehicle body dimension data is stored in the storage device 28 and indicates the position of the work implement 13 with respect to the GNSS receiver 32. The controller 26 calculates the global coordinates of the blade tip position P0 on the basis of the global coordinates of the GNSS receiver 32, the local coordinates of the blade tip position P0, and the vehicle body inclination angle data. The controller 26 obtains the global coordinates of the blade tip position P0 as blade tip position data. The blade tip position P0 may also be calculated directly by attaching the GNSS received to the blade 18.

The storage device 28 includes, for example, a memory and an auxiliary storage device. The storage device 28 may be a RAM or a ROM, for example. The storage device 28 may be a semiconductor memory or a hard disk and the like. The storage device 28 is an example of a non-transitory computer-readable recording medium. The storage device 28 stores computer commands for controlling the work vehicle 1 and that are executable by the processor.

The storage device 28 stores work site topographical data. The work site topographical data indicates an actual topography of the work site. The work site topographical data is, for example, a topographical survey map in a three-dimensional data format. The work site topographical data can be obtained, for example, by aeronautical laser surveying.

The controller 26 obtains topographical data. The topographical data indicates a topography 50 of the work site. The topography 50 is the topography of the region along the traveling direction of the work vehicle 1. The topographical data is obtained by calculation by the controller 26 from the work site topographical data and from the position and the traveling direction of the work vehicle 1 obtained by the abovementioned position sensor 31.

Figure 4:
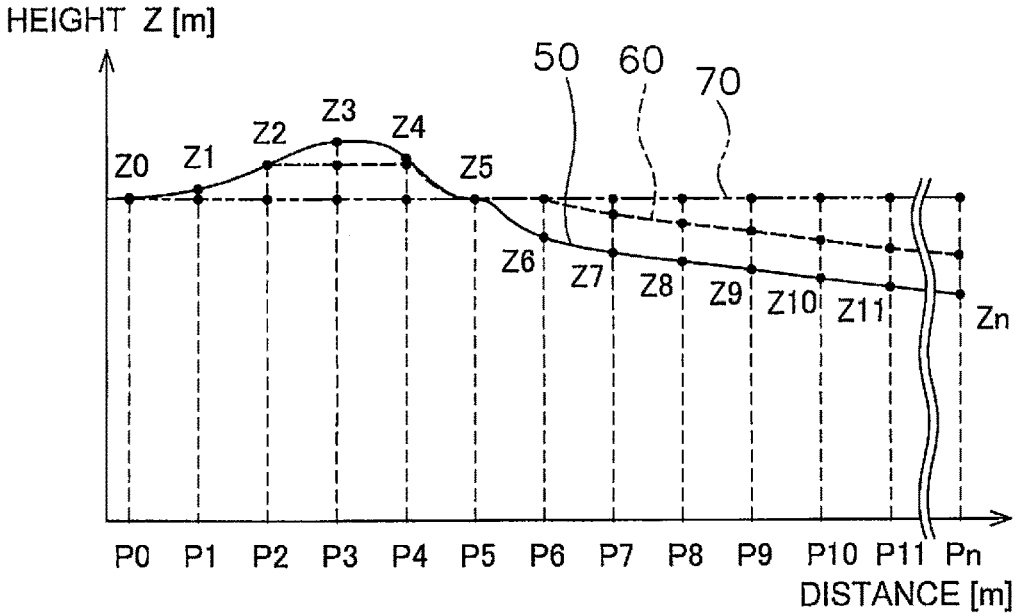
FIG. 4 is an example of a design surface and a topography.

FIG. 4 is an example of a cross-section of the topography 50. As illustrated in FIG. 4, the topographical data includes heights of the topography 50 at a plurality of reference points P0 to Pn. Specifically, the topographical data includes heights Z0 to Zn of the topography 50 at the plurality of reference points P0 to Pn in the traveling direction of the work vehicle 1. The plurality of reference points P0 to Pn are arranged at a predetermined interval between each point. The predetermined interval is, for example, 1 m, but may be another value.

In FIG. 4, the vertical axis indicates the height of the topography and the horizontal axis indicates the distance from the current position in the traveling direction of the work vehicle 1. The current position may be a position defined on the basis of the current blade tip position P0 of the work vehicle 1. The current position may also be defined on the basis of the current position of another portion of the work vehicle 1.

The storage device 28 stores design surface data. The design surface data indicates a plurality of design surfaces 60 and 70 which are target loci of the work implement 13. As illustrated in FIG. 4, the design surface data includes the heights of the design surfaces 60 and 70 at the reference points P0 to Pn in the same way as the topographical data. The plurality of design surfaces 60 and 70 include a final design surface 70 and an intermediate target design surface 60 other than the final design surface 70.

The final design surface 70 is the final target shape of the outer surface of the work site. The final design surface 70 is, for example, a construction work drawing in a three-dimensional data format and is previously saved in the storage device 28. While the final design surface 70 has a shape that is flat and parallel to the horizontal direction in FIG. 4, the shape of the final design surface 70 may be different.

At least a portion of the target design surface 60 is positioned between the final design surface 70 and the topography 50. The controller 26 can generate a desired target design surface 60, generate design surface data indicative of the target design surface 60, and save the design surface data in the storage device 28.

Figure 5:
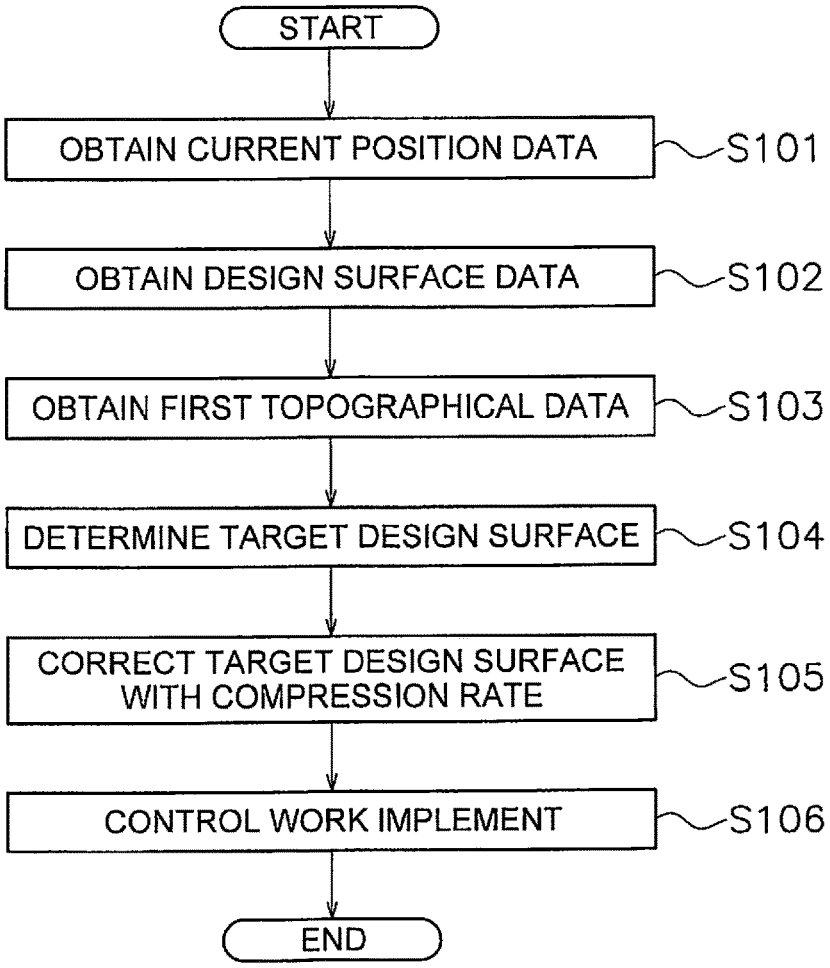
FIG. 5 is a flow chart illustrating automatic control processing of the work implement.

The controller 26 automatically controls the work implement 13 on the basis of the topographical data, the design surface data, and the blade tip position data. Automatic control of the work implement 13 executed by the controller 26 will be explained below. FIG. 5 is a flow chart illustrating automatic control processing of the work implement 13.

As illustrated in FIG. 5, in step S101, the controller 26 obtains current position data. The current position data indicates a position of the work vehicle 1 measured by the position sensor 31. As described above, the controller 26 obtains the current blade tip position P0 of the work implement 13 from the current position data. In step S102, the controller 26 obtains the design surface data. The controller 26 obtains the design surface data from the storage device 28.

In step S103, the controller 26 obtains first topographical data. The controller 26 obtains the first topographical data indicative of the current topography 50 from the work site topographical data and from the position and the traveling direction of the work vehicle 1. Alternatively, as described later, the controller 26 obtains the first topographical data indicative of the topography 50 updated by the work vehicle 1 moving over the topography 50.

In step S104, the controller 26 determines the target design surface. The controller 26 generates the target design surface 60 positioned between the final design surface 70 and the topography 50 from the design surface data indicative of the final design surface 70 and from the topographical data.

For example, the controller 26 determines a surface formed by displacing the topography 50 in the vertical direction by a predetermined distance, as the target design surface 60. The controller 26 may correct a portion of the target design surface 60 so as to soften the inclination angle if the inclination angle of the target design surface 60 is steep.

In step S105, the controller 26 corrects the target design surface 60 on the basis of the compression rate of the soil. The correction of the target design surface 60 based on the compression rate of the soil is explained in detail below.

In step S106, the controller 26 controls the work implement 13. The controller 26 automatically controls the work implement 13 in accordance with the target design surface 60. Specifically, the controller 26 generates a command signal for the work implement 13 so as to move the blade tip position P0 of the blade 18 toward the target design surface 60. The generated command signal is input to the control valve 27. Consequently, the blade tip position P0 of the work implement 13 moves along the target design surface 60.

For example, when the target design surface 60 is positioned higher than the topography 50, soil is piled on top of the topography 50 by the work implement 13. In addition, when the target design surface 60 is positioned lower than the topography 50, the topography 50 is excavated by the work implement 13.

The controller 26 may start the control of the work implement 13 when a signal for operating the work implement 13 is outputted by the operating device 25*a*. The movement of the work vehicle 1 may be performed manually by an operator operating the operating device 25*a*. Alternatively, the movement of the work vehicle 1 may be performed automatically with command signals from the controller 26.

The above processing is carried out when the work vehicle 1 is traveling forward. For example, when the operating device 25*a* for the travel device 12 is in the forward movement position, the above processing is executed and the work implement 13 is controlled automatically. When the work vehicle 1 travels in reverse, the controller 26 stops the control of the work implement 13. For example, when the operating device 25*a* for the travel device 12 is in the reverse movement position, the controller 26 stops the control of the work implement 13. Thereafter, when the work vehicle 1 starts to travel forward again, the controller 26 executes the processing of the abovementioned steps S101 to S106 again.

Due to the abovementioned processing, the work vehicle 1 starts to travel forward during the filling work and the blade tip position of the work implement 13 is controlled so as to move along the target design surface 60, whereby the soil is piled in a layer on the topography 50. The work vehicle 1 then travels over the soil piled in a layer whereby the soil is compacted by the crawler belts 16 and a compacted layer of soil is formed. The control of the work implement 13 is stopped when the work vehicle 1 starts to travel in reverse.

In this way, the step from when the work vehicle 1 starts to travel forward until the work vehicle 1 switches to reverse travel is referred to as one work path. The work vehicle 1 travels in reverse and returns to the work starting position and then once again the work vehicle 1 starts to travel forward, whereby the next work path is started. By repeating the work paths in this way, for example, the depressed topography is filled in and a flat shape can be formed.

Figure 6:
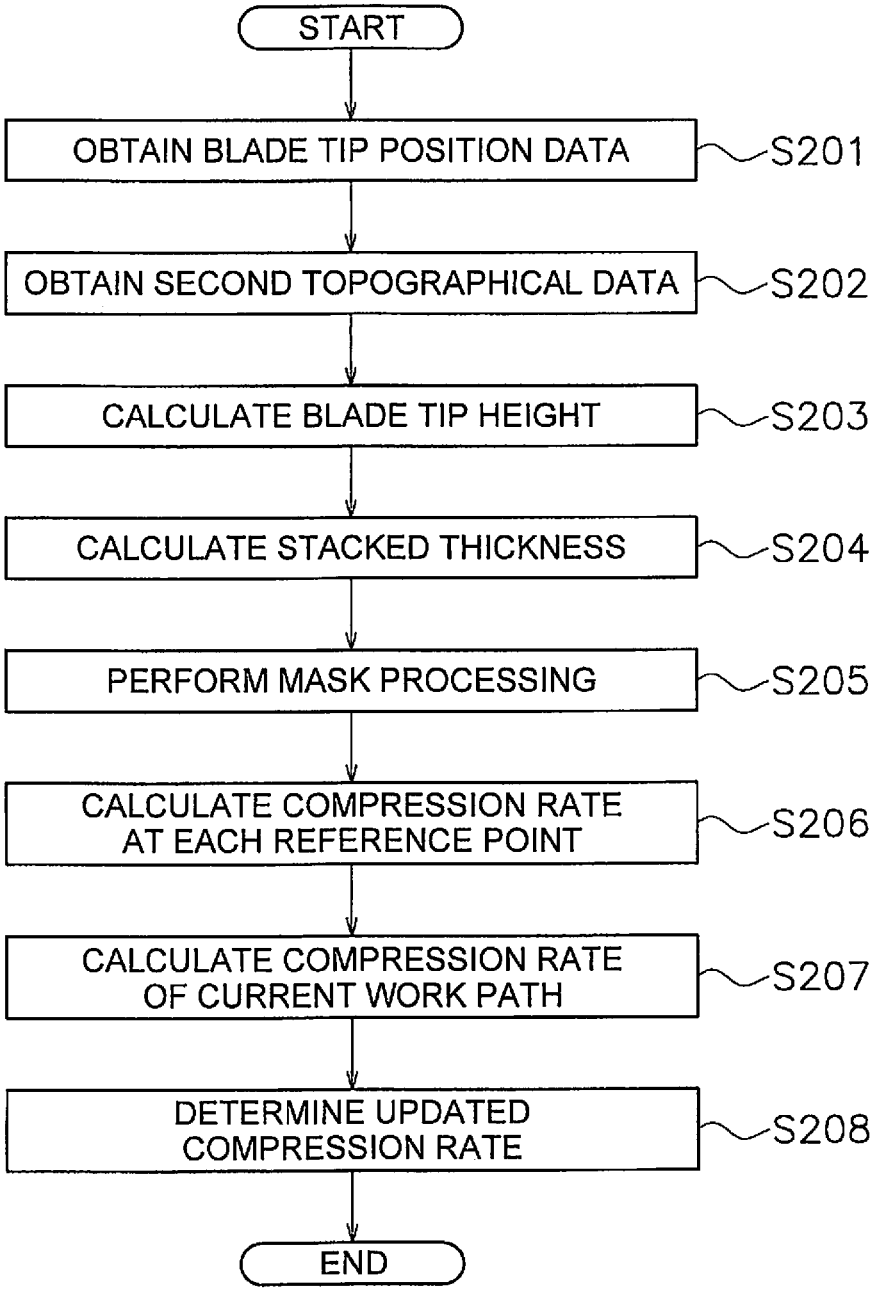
FIG. 6 is a flow chart illustrating processing for determining a compression rate.

Correction of the target design surface 60 due to the compression rate will be explained next. FIG. 6 is a flow chart illustrating processing for determining the compression rate. The processing illustrated in FIG. 6 is executed during one work path.

Figure 7:
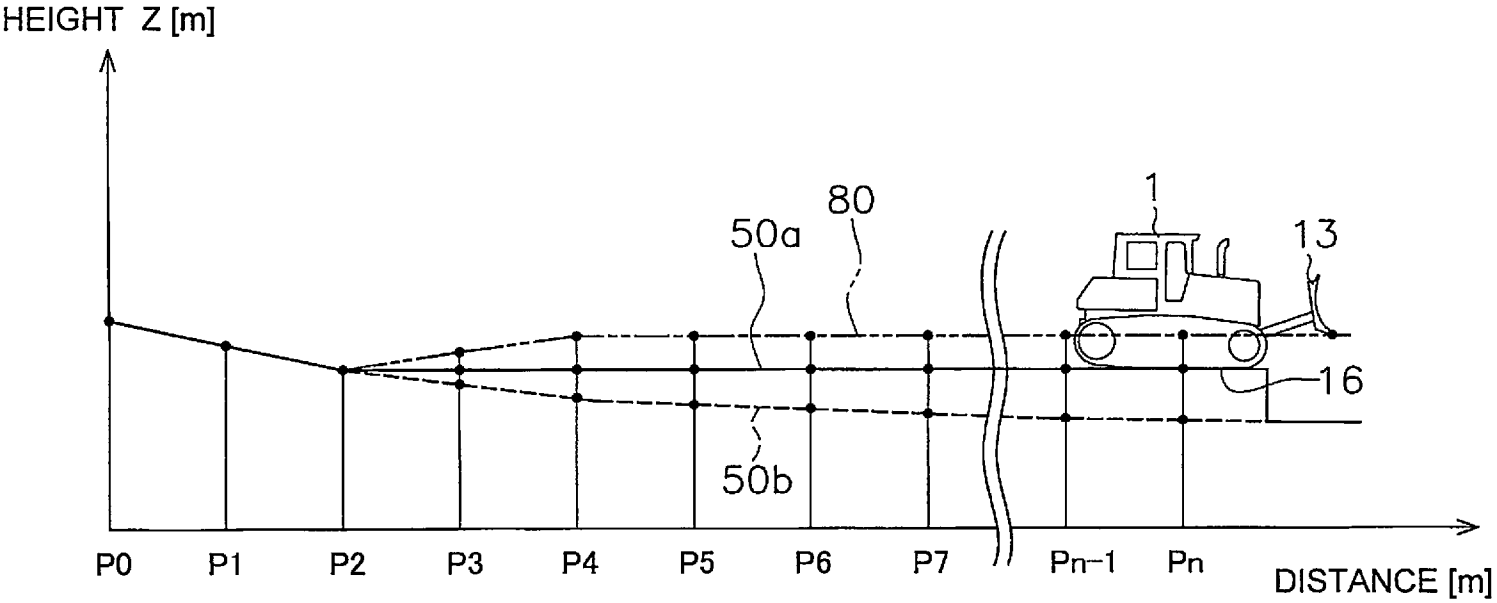
FIG. 7 is an example a first topography, a second topography, and the locus of a blade tip position.

As illustrated in FIG. 6, in step S201, the controller 26 obtains the blade tip position data. As illustrated in FIG. 7, the controller 26 records the heights of the blade tip positions at the plurality of reference points P1 to Pn during the filling work and obtains the blade tip position data indicative of a locus 80 of blade tip positions.

In step S202, the controller 26 obtains second topographical data. As illustrated in FIG. 7, the second topographical data indicates a topography 50*a* (referred to below as "second topography 50*a*") that is compacted after the filling work performed in the current work path. The abovementioned first topographical data indicates a topography 50*b* (referred to below as "first topography 50*b*") before the filling work performed in the current work path.

The controller 26 calculates the position of the bottom surface of the crawler belts 16 from the vehicle body position data and the vehicle body dimension data. As illustrated in FIG. 7, the controller 26 obtains a position data indicating the locus of the bottom surface of the crawler belts 16 as the second topographical data.

Within the bottom surface of the crawler belts 16, the locus of the portion positioned directly below the center of gravity of the work vehicle 1 when viewing the vehicle from the side, is preferably obtained as the second topographical data. However, the locus of another portion of the work vehicle 1 may be obtained as the second topographical data.

Figure 8:
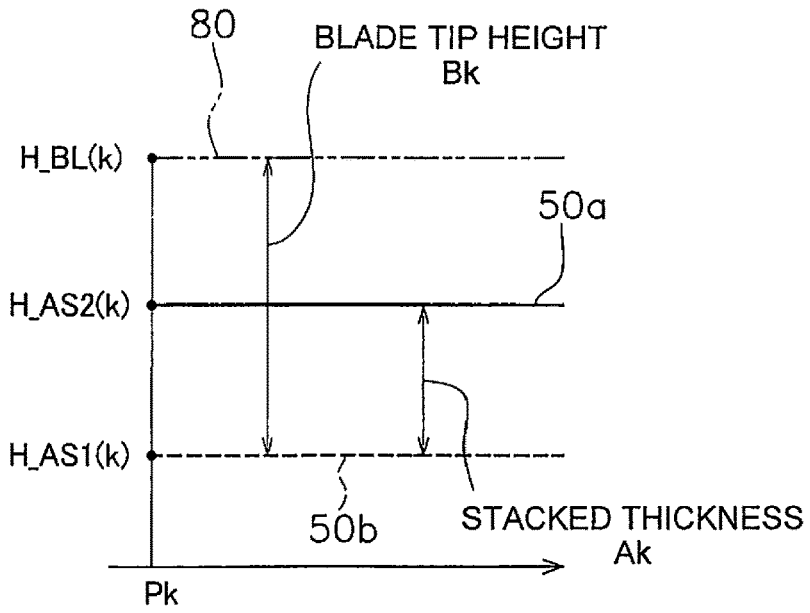
FIG. 8 illustrates a method for determining a blade tip height and a stacked thickness.

In step S203, the controller 26 calculates a blade tip height. As illustrated in FIG. 8, the controller 26 calculates the blade tip height Bk (where k=1, 2, . . . , n) at each reference point Pk. The blade tip height Bk indicates the height from the first topography 50*b* to the locus 80 of the blade tip position. That is, the blade tip height Bk indicates the height from the topography 50*b* before the filling work performed during the current work path to the locus 80 of the blade tip position, and signifies the thickness of the soil piled up by the current work path.

The controller 26 calculates the blade tip heights at the plurality of reference points P1 to Pn from the first topographical data and the blade tip position data. As illustrated in FIG. 8, the controller 26 determines a height H_AS1(k) of the first topography 50*b* at the reference point Pk from the first topographical data. Moreover, the controller 26 determines the height H_BL(k) of the blade tip position at the reference point Pk from the blade tip position data. The controller 26 then subtracts the height H_AS1(k) of the first topography 50*b* from the height H_BL(k) of the blade tip position to determine the blade tip height Bk at the reference point Pk.

In step S204, the controller 26 calculates a stacked thickness. As illustrated in FIG. 8, the controller 26 calculates stacked thicknesses Ak (where k=1, 2, . . . , n) at each reference point Pk. The stacked thickness Ak indicates the height from the first topography 50*b* to the second topography 50*a*. That is, the stacked thickness Ak indicates the height from the topography 50*b* before the filling work performed during the current work path, to the topography 50*a* compacted after the filling work, and signifies the thickness of the layer of compacted soil after the blade tip has passed through.

The controller 26 calculates the stacked thicknesses at the plurality of reference points P1 to Pn from the first topographical data and the second topographical data. As illustrated in FIG. 8, the controller 26 determines a height H_AS2(k) (where k=1, 2, . . . , n) of the second topography 50*a* at the reference point Pk from the second topographical data. The controller 26 then subtracts the height H_AS1(k) of the first topography 50*b* from the height H_AS2(k) second topography 50*a* to determine the stacked thickness Ak at the reference point Pk.

In step S205, the controller 26 performs mask processing. The controller 26 whether the blade tip height Bk and the stacked thickness Ak at each reference point Pk are included in a predetermined effective range. The controller 26 determines the data indicative of the blade tip height Bk and the stacked thickness Ak included within the effective range, as effective data to be used for determining the compression rate.

Figure 9:
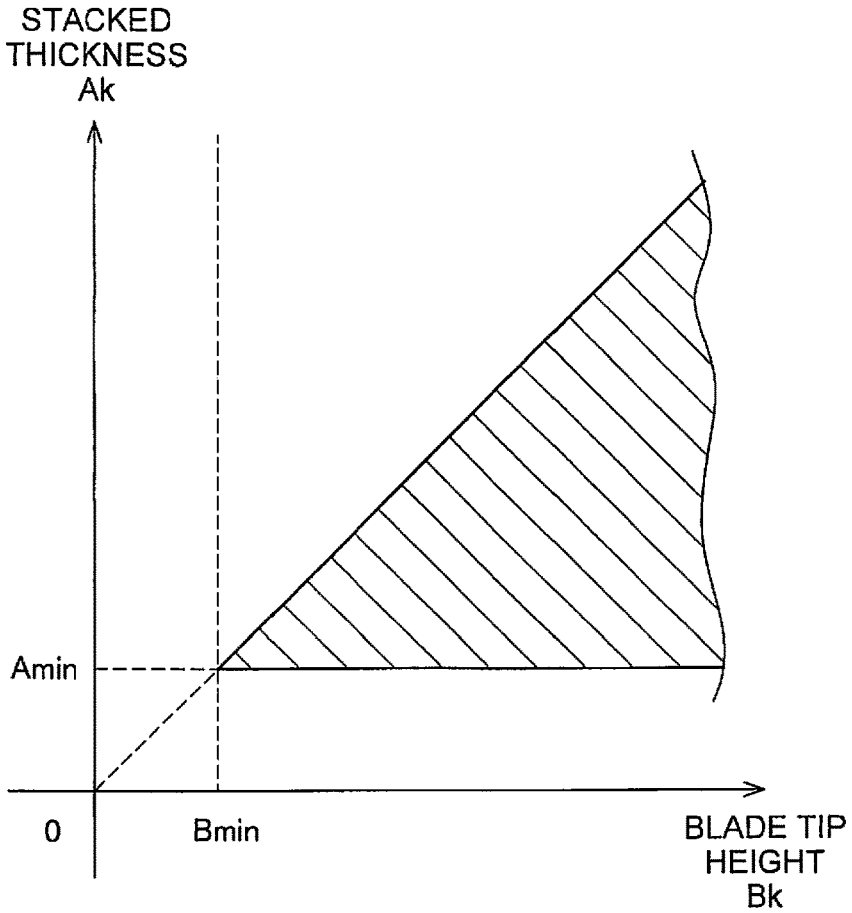
FIG. 9 is an example of an effective range of data for mask processing.

FIG. 9 illustrates an effective range for the mask processing. The horizontal axis in FIG. 9 depicts the blade tip height Bk and the vertical axis depicts the stacked thickness Ak. The blade tip height Bk and the stacked thickness Ak included in the effective range that is hatched in FIG. 9 is treated as the effective data. The effective range is a range where the stacked thickness Ak is greater than a lower limit Amin of the stacked thickness, the blade tip height Bk is greater than a lower limit Bmin of the blade tip height, and the blade tip height Bk is greater than the stacked thickness Ak.

In step S206, the controller 26 calculates the compression rate at each reference point Pk. The controller 26 uses the data of the blade tip height Bk and the stacked thickness Ak that has been determined as effective in step S205, to calculate the compression rate. The controller 26 calculates the compression rate Rk (%) at each reference point Pk using the following equation (1).

$$Rk=(Bk-Ak)/Bk*100 \quad (1)$$

In step S207, the controller 26 calculates the compression rate of the current work path. The controller 26 determines the compression rates over the entire current work path. The controller 26 uses the compression rate at each reference point Pk calculated from the effective data to determine the compression rate of the current work path. For example, the controller 26 determines an average value of the compression rates at the reference points Pk calculated in step S206 as the compression rate of the current work path. However, a value other than the average value of the compression rates at each reference point Pk may be determined as the compression rate of the current work path.

In step S208, the controller 26 calculates an updated compression rate. The controller 26 calculates the updated compression rate on the basis of the compression rate of the previous work path and the compression rate of the current work path. That is, the controller 26 calculates the values of the compression rates for each of a plurality of paths of the filling work and updates the compression rate on the basis of the previous value and the current value of the compression rates. For example, the controller 26 determines an average value of the previous value and the current value of the compression rates as the updated compression rate. Consequently, by executing the work paths multiple times, the compression rates can be updated gradually and a sudden change in the compression rate can be inhibited.

In the abovementioned step S105, the controller 26 corrects the target design surface 60 using the updated compression rate. For example, in FIG. 10, "60" indicates an initial target design surface 60 determined by the controller 26 in step S104. The controller 26 generates a corrected target design surface by raising the initial target design surface 60 on the basis of the compression rate.

Figure 10:
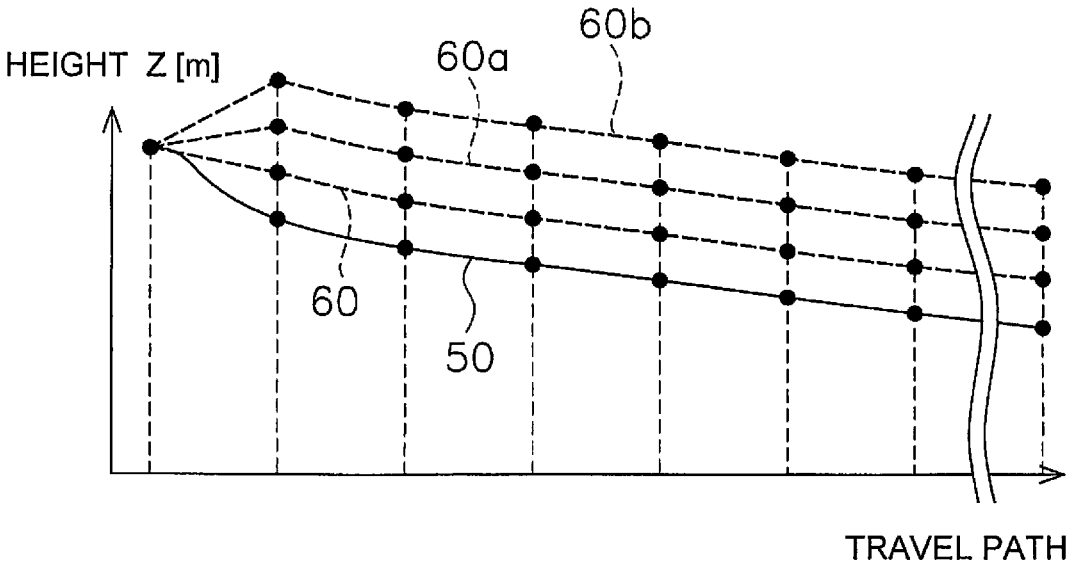
FIG. 10 illustrates an example of a target design surface corrected according to a compression rate.

In FIG. 10, "60*a*" indicates the corrected target design surface when the compression rate is a predetermined value r1. "60*b*" indicates the corrected target design surface when the compression rate is a predetermined value r2 (>r1). As illustrated in FIG. 10, the controller 26 raises the position of the corrected target design surface with respect to the initial target design surface 60 in correspondence to a higher compression rate.

When one work path is completed, the controller 26 updates a second topography 50*aa* as a first topography 50*bb*. In the next work path, the controller 26 executes the above processing from step S101 to step S106 using the first topographical data indicative of the updated first topography 50*bb*.

According to the control system 3 of the work vehicle 1 as in the present embodiment, when the target design surface 60 is positioned higher than the topography 50, the soil can be piled thinly on the topography 50 by controlling the work implement 13 along the target design surface 60. Further, when the target design surface 60 is positioned lower than the topography 50, excavating can be performed while suppressing an excessive load on the work implement 13 by controlling the work implement 13 along the target design surface 60. Accordingly, the quality of the finished work can be improved. Moreover, work efficiency can be improved with the automatic control.

The controller 26 determines the compression rate of the soil from the first topographical data, the blade tip position data, and the second topographical data, and corrects the target design surface 60 on the basis of the compression rate. As a result, the target design surface 60 can be corrected in accordance with the actual compression rate of the soil. Consequently, the layers of soil can be easily formed to the desired thickness.

The controller 26 updates the compression rate on the basis of the compression rate of the current work path and the compression rate of the previous work path. Therefore, a highly accurate compression rate can be obtained by repeating the work paths multiple times.

Although one embodiment of the present invention has been described so far, the present invention is not limited to the above embodiment and various modifications may be made within the scope of the invention.

The work vehicle 1 is not limited to a bulldozer, and may be another type of work vehicle such as a wheel loader or a motor, grader, or the like. The work vehicle 1 may be a vehicle that can be remotely operable. In this case, a portion of the control system 3 may be disposed outside of the work vehicle 1. For example, the controller 26 may be disposed outside the work vehicle 1. The controller 26 may be disposed inside a control center separated from the work site.

Figure 11:
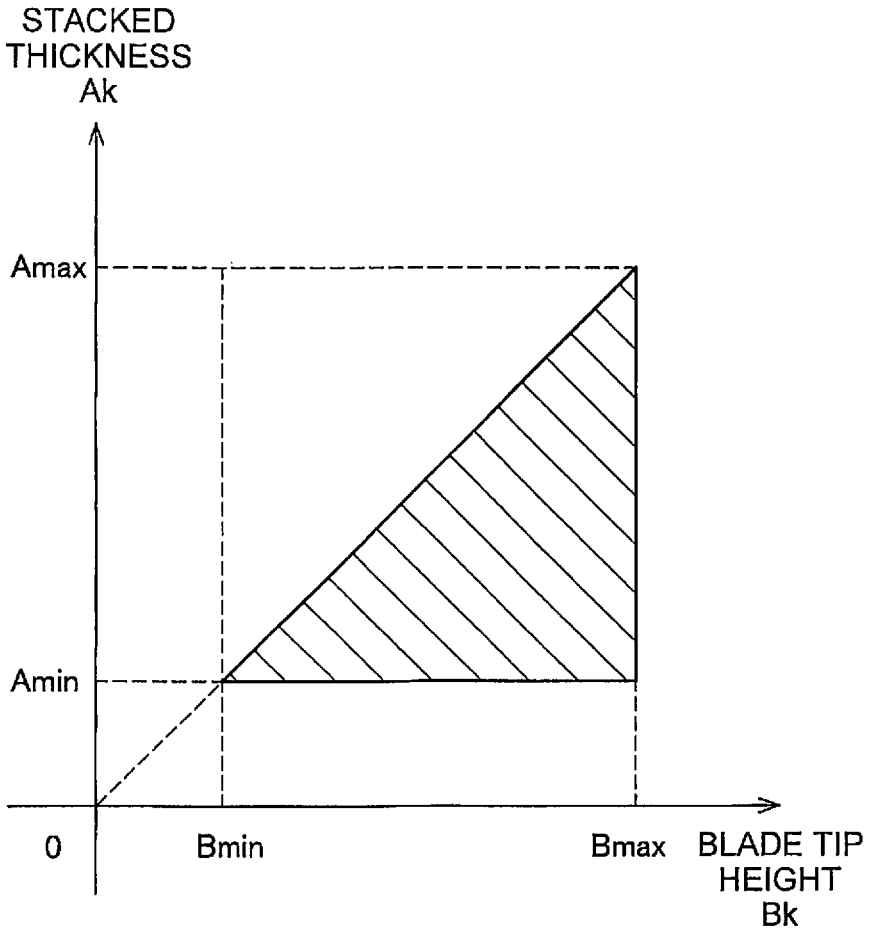
FIG. 11 is another example of an effective range of data for mask processing.

The method for determining the compression rate is not limited to the method described above and may be modified. For example, the compression rate may be updated using only the current work path without using the compression rate of the previous work path. The mask processing may be modified. For example, as illustrated in FIG. 11, the effective range may be regulated with an upper limit Bmax of the blade tip height Bk. The effective range may also be regulated with an upper limit Amax of the stacked thickness Ak. Alternatively, the mask processing may be omitted.

Instead of the controller 26 controlling the work implement 13 in accordance with the target design surface 60, a guidance screen which shows the target design surface 60 may be displayed on a display. In this case, a suitable target design surface 60 can be presented to the operator by displaying the target design surface 60 corrected with the compression rate on the guidance screen.

Figure 12:
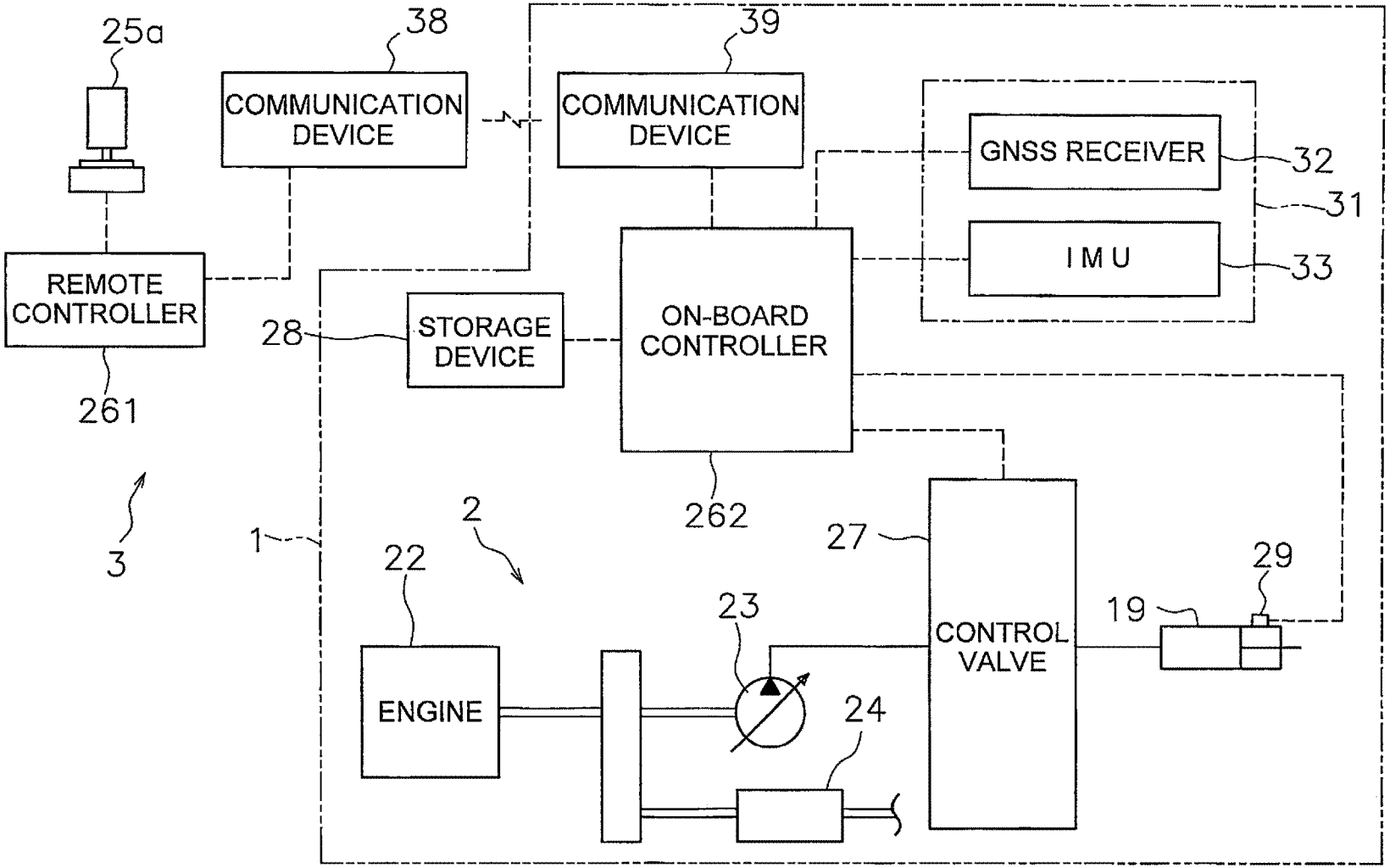
FIG. 12 is a block diagram illustrating a configuration of a drive system and a control system of a work vehicle according to another embodiment.

The controller 26 may include a plurality of controllers 26 separate from each other. For example as illustrated in FIG. 12, the controller 26 may include a remote controller 261 disposed outside of the work vehicle 1 and an on-board controller 262 mounted on the work vehicle 1. The remote controller 261 and the on-board controller 262 may be able to communicate wirelessly via communication devices 38 and 39. A portion of the abovementioned functions of the controller 26 may be executed by the remote controller 261, and the remaining functions may be executed by the on-board controller 262. For example, the processing for determining the target design surface 60 may be performed by the remote controller 261, and the process for outputting the command signals to the work implement 13 may be performed by the on-board controller 262.

The operating device 25*a* may also be disposed outside of the work vehicle 1. In this case, the operating cabin may be omitted from the work vehicle 1. Alternatively, the operating device 25*a* may be omitted from the work vehicle 1. The work vehicle 1 may be operated with only the automatic control by the controller 26 without operations using the operating device 25*a*.

Figure 13:
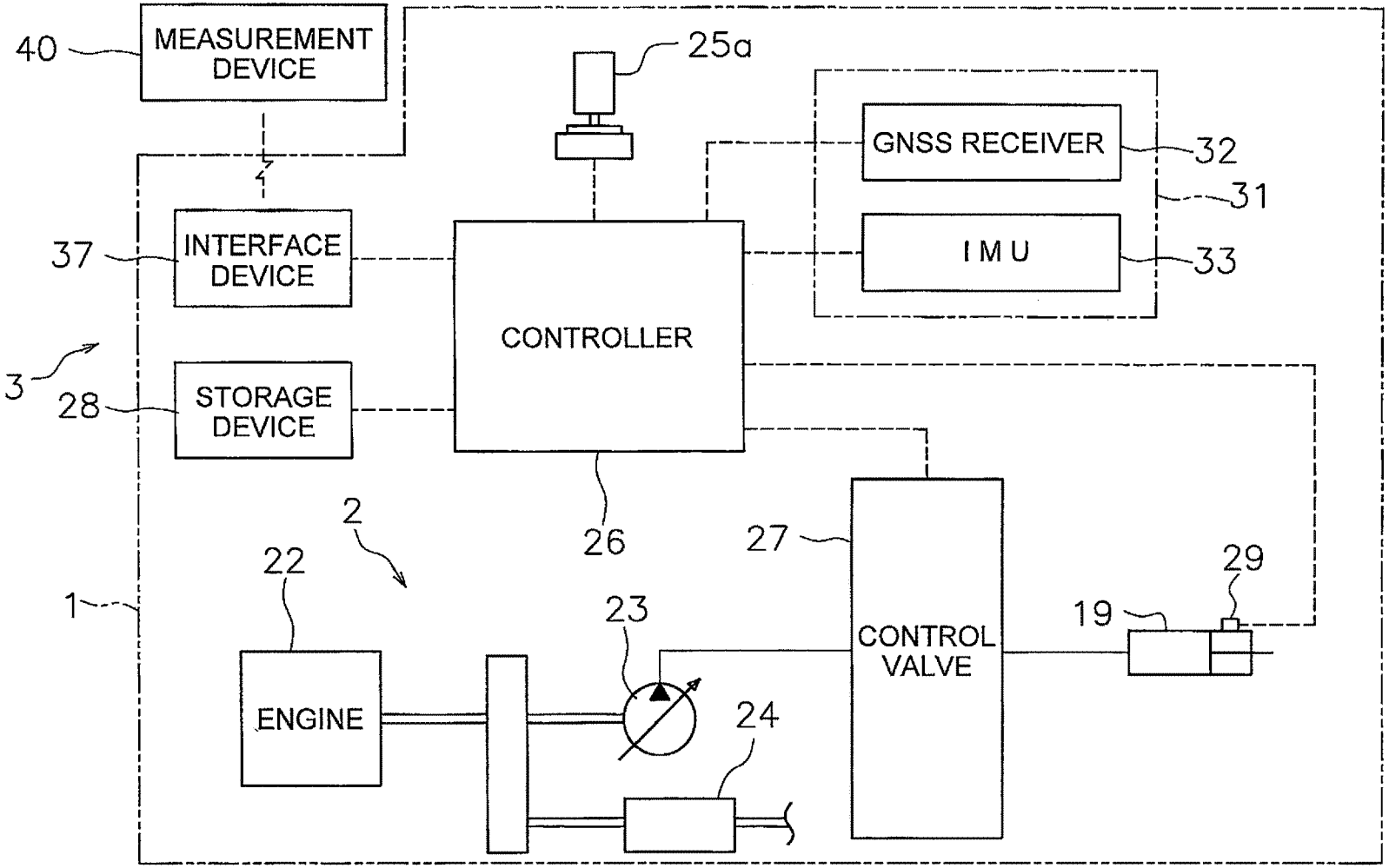
FIG. 13 is a block diagram illustrating a configuration of a drive system and a control system of a work vehicle according to another embodiment.

The topography 50 may be obtained with another device and is not limited to being obtained with the abovementioned position sensor 31. For example, as illustrated in FIG. 13, the topography 50 may be obtained with an interface device 37 that accepts data from an external device. The interface device may wirelessly receive topographical data measured by an external measurement device 40.

For example, aeronautical laser surveying may be used with the external measurement device. Alternatively, the topography 50 may be imaged by a camera and the topographical data may be generated from image data captured by the camera. For example, aerial photography surveying performed with an unmanned aerial vehicle (UAV) may be used. Alternatively, the interface device 37 may be a recording medium reading device and may accept the topographical data measured by the external measurement device 40 via a recording medium.

The second topographical data may be data indicative of the topography 50 compacted by a vehicle other than the work vehicle 1 such as a roller vehicle. In this case, the second topographical data may be obtained by using a positional sensor mounted on the roller vehicle. Alternatively, the second topographical data may be obtained using an external measurement device.

According to the present invention, there are provided a control system for a work vehicle, a method, and a work vehicle that enable filling work that is efficient and exhibits a quality finish.

What is claimed is:

1. A control system for a work vehicle including a blade as a work implement, the control system comprising:

a controller configured to obtain first topographical data indicative of a topography of a work target before filling work, obtain blade tip position data indicative of a blade tip position of the blade during the filling work, obtain second topographical data indicative of a compacted topography after the filling work, use the first topographical data and the blade tip position data to determine a blade tip height indicative of a height from the topography before the filling work to the blade tip position at a plurality of reference points on a travel path of the work vehicle, determine a stacked thickness of piled soil from the first topographical data and the second topographical data at the plurality of reference points, and determine a compression rate of the work target from the blade tip height and the stacked thickness at the plurality of reference points.

2. The control system for a work vehicle according to claim 1, wherein the controller is further configured to determine whether the blade tip height and the stacked thickness at the plurality of reference points is included within a predetermined effective range, and determine the compression rate from the blade tip height and the stacked thickness at the plurality of reference points included within the effective range.

3. The control system for a work vehicle according to claim 1, wherein the controller is further configured to calculate a value of the compression rate for each of a plurality of work paths of the filling work, and update the compression rate based on a previous value and a current value of the compression rate.

4. The control system for a work vehicle according to claim 1, wherein the controller is further configured to determine a target design surface and correct the target design surface with the compression rate.

5. The control system for a work vehicle according to claim 4, wherein the controller is further configured to correct the target design surface by raising the target design surface in correspondence to an increase in the compression rate.

6. The control system for a work vehicle according to claim 1, wherein the blade is attached to a front portion of a vehicle body of the work vehicle and configured to move up and down relative to the vehicle body.

7. The control system for a work vehicle according to claim 1, wherein the blade tip position data is indicative of a locus of blade tip positions occupied by the blade during the filling work, the height at each of the reference points is a distance between the locus and the topography before the filling work.

8. A method executed by a controller in order to determine a compression rate of a work target to be subjected to filling work with a blade of a work vehicle, the method comprising:

obtaining first topographical data indicative of a topography of the work target before filling work;

obtaining blade tip position data indicative of a blade tip position of the blade during the filling work;

obtaining second topographical data indicative of a compacted topography after the filling work;

using the first topographical data and the blade tip position data to determine a blade tip height indicative of a height from the topography before the filling work to the blade tip position at a plurality of reference points on a travel path of the work vehicle;

determining a stacked thickness of piled soil from the first topographical data and the second topographical data at the plurality of reference points; and determining a compression rate of the work target from the blade tip height and the stacked thickness at the plurality of reference points.

9. The method according to claim 8, further comprising:

determining whether the blade tip height and the stacked thickness at the plurality of reference points is included within a predetermined effective range, the compression rate being determined from the blade tip height and the stacked thickness at the plurality of reference points included within the effective range.

10. The method according to claim 8, further comprising calculating a value of the compression rate for each of a plurality of work paths of the filling work; and updating the compression rate based on a previous value and a current value of the compression rate.

11. The method according to claim 8, further comprising:

determining a target design surface; and correcting the target design surface with the compression rate.

12. The method according to claim 11, wherein the target design surface is corrected by raising the target design surface in correspondence to an increase in the compression rate.

13. A work vehicle comprising:

a blade as a work implement; and a controller configured to control the blade, the controller being configured to obtain first topographical data indicative of a topography of a work target before filling work, obtain blade tip position data indicative of a blade tip position of the blade during the filling work, obtain second topographical data indicative of a compacted topography after the filling work, determine a compression rate of the work target from the first topographical data, the blade tip position data, and the second topographical data, and control the blade based on the compression rate, the controller determining the compression rate by using the first topographical data and the blade tip position data to determine a blade tip height indicative of a height from the topography before the filling work to the blade tip position at a plurality of reference points on a travel path of the work vehicle, determining a stacked thickness of piled soil from the first topographical data and the second topographical data at the plurality of reference points, and determining the compression rate from the blade tip height and the stacked thickness at the plurality of reference points.

14. The work vehicle according to claim 13, wherein the controller is further configured to determine whether the blade tip height and the stacked thickness at the plurality of reference points is included within a predetermined effective range, and determine the compression rate from the blade tip height and the stacked thickness at the plurality of reference points included within the effective range.

15. The work vehicle according to claim 13, wherein the controller is further configured to calculate a value of the compression rate for each of a plurality of work paths of the filling work, and update the compression rate based on a previous value and a current value of the compression rate.

16. The work vehicle according to claim 13, wherein the controller is further configured to determine a target design surface, and correct the target design surface with the compression rate.

17. The work vehicle according to claim 16, wherein the controller is further configured to correct the target design surface by raising the target design surface in correspondence to an increase in the compression rate.

* * * * *